United States Patent [19]

Benson et al.

[11] Patent Number: 4,572,711

[45] Date of Patent: Feb. 25, 1986

[54] PRESTRESSED COMPONENT RETAINING WALL SYSTEM

[75] Inventors: Cade L. Benson, Parker, Colo.; John W. Babcock, Huntsville, Utah

[73] Assignee: Stresswall International, Inc., Denver, Colo.

[21] Appl. No.: 496,857

[22] Filed: May 23, 1983

[51] Int. Cl.[4] ..... E02D 29/02

[52] U.S. Cl. ..... 405/286; 52/227; 405/273; 405/284

[58] Field of Search ..... 405/284, 285, 286, 287, 405/272, 273; 52/227, 226

[56] References Cited

U.S. PATENT DOCUMENTS

| | | | |
|---|---|---|---|
| 1,356,319 | 10/1920 | Smulski | 405/286 |
| 1,778,574 | 10/1930 | Thornley | 405/286 |
| 1,909,299 | 5/1933 | Mette | 405/284 |
| 2,908,139 | 10/1959 | Horton et al. | 405/284 |
| 3,226,894 | 1/1966 | Burchardt et al. | 52/227 X |
| 4,050,254 | 9/1977 | Meheen et al. | 405/286 X |
| 4,260,296 | 4/1981 | Hilfiker | 405/287 X |
| 4,341,491 | 7/1982 | Neumann | 405/284 X |
| 4,384,810 | 5/1983 | Neumann | 405/284 |

FOREIGN PATENT DOCUMENTS

| | | | |
|---|---|---|---|
| 8814 | of 1900 | United Kingdom | 405/286 |
| 1402 | of 1908 | United Kingdom | 405/284 |

*Primary Examiner*—Dennis L. Taylor

*Attorney, Agent, or Firm*—William W. Cochran, II

[57] ABSTRACT

A retaining wall system utilizing a support structure formed from standard concrete Tee forms. The structural members are assembled using post tensioning devices which impart added strength to the component members. Wall can be employed in a tier configuration, can utilize cross tie members, counterbalancing slabs and foot support devices to offset bending moment forces. The base member can be formed in a Tee configuration or as a single slab unit. The invention can utilize continuous footers and retaining flanges for holding the wall segments.

10 Claims, 29 Drawing Figures

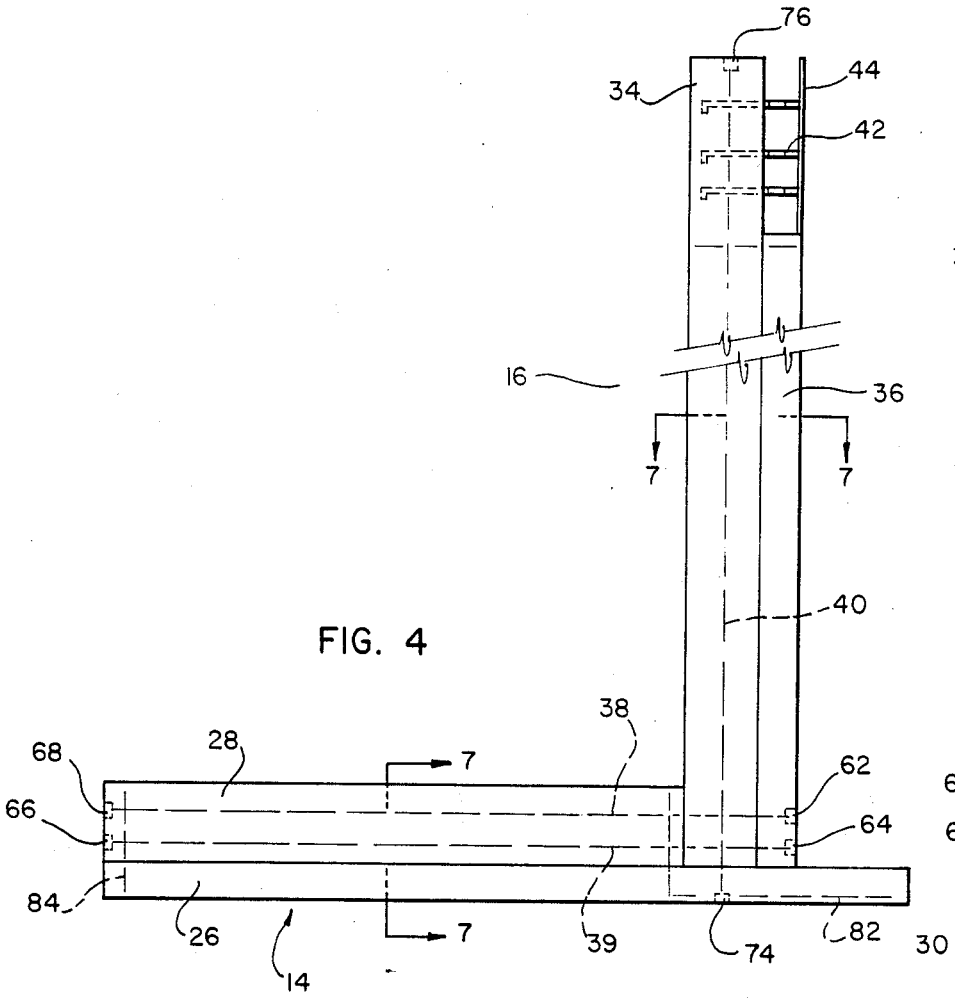
FIG. 4
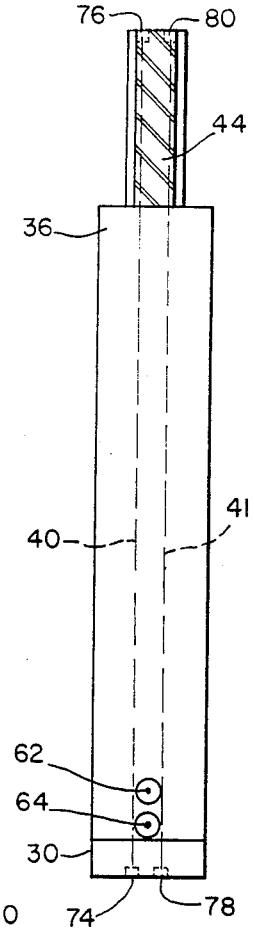
FIG. 5
FIG. 6
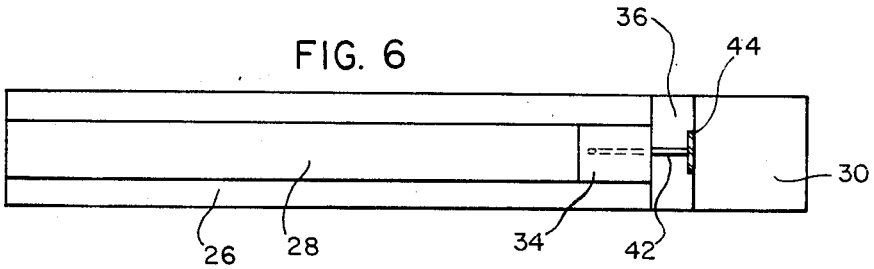
FIG. 3
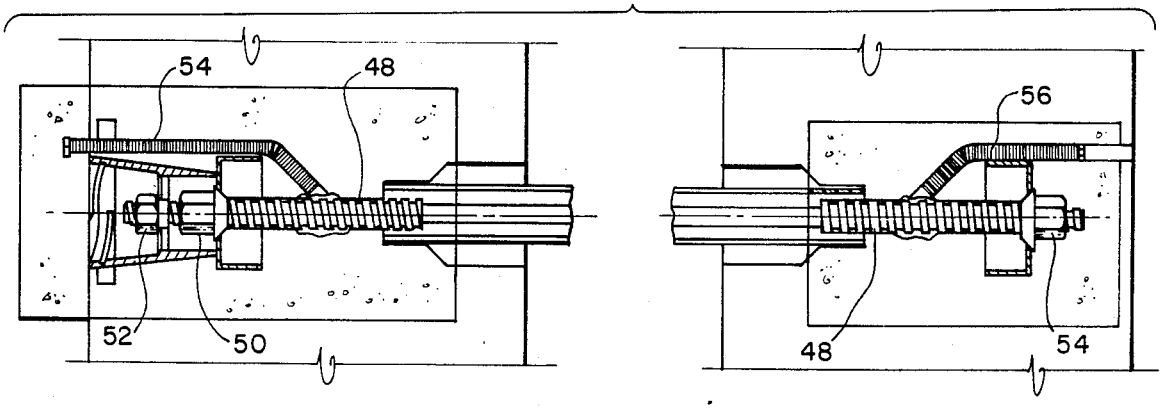

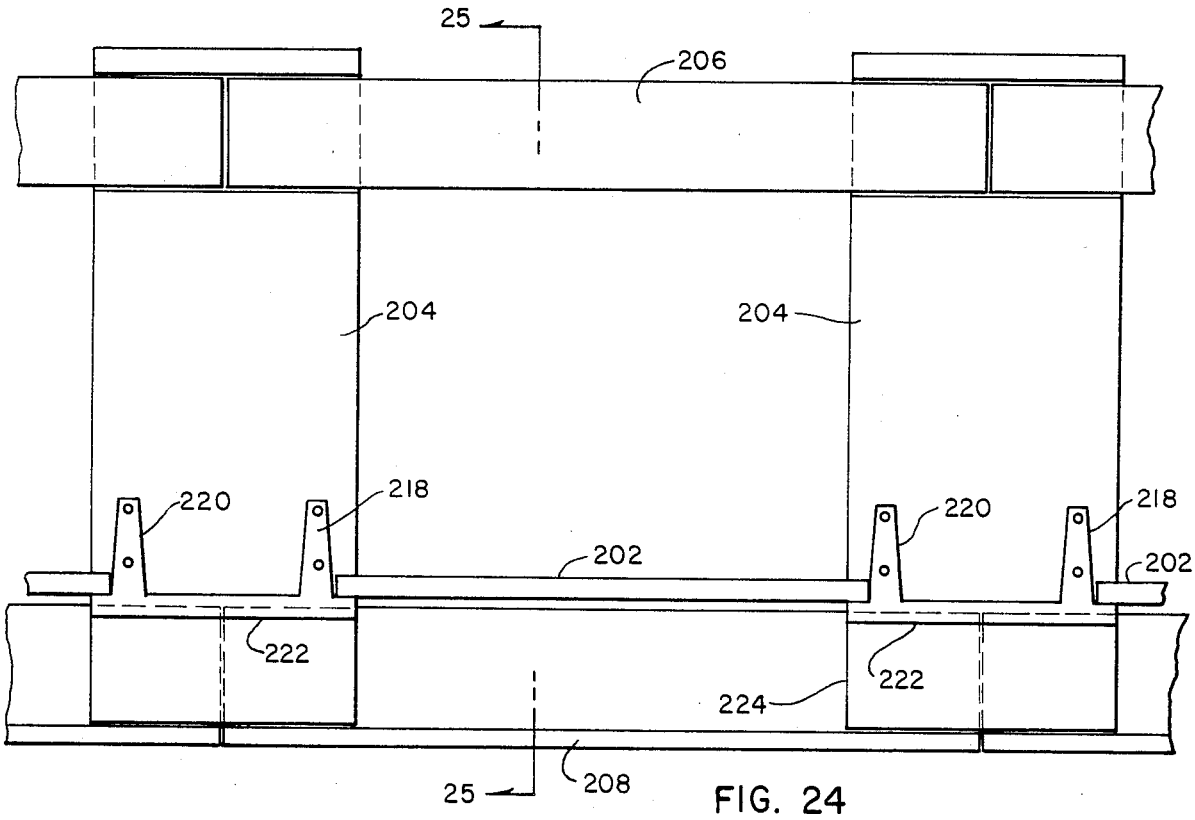
FIG. 24
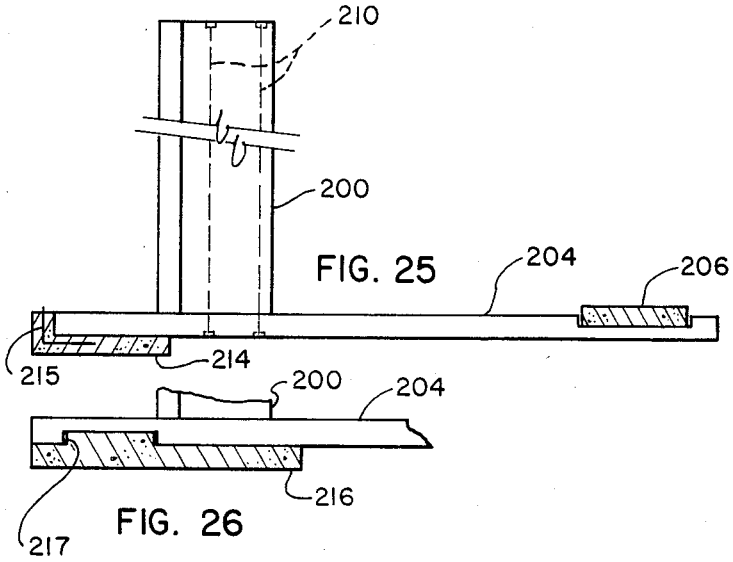
FIG. 25
FIG. 26
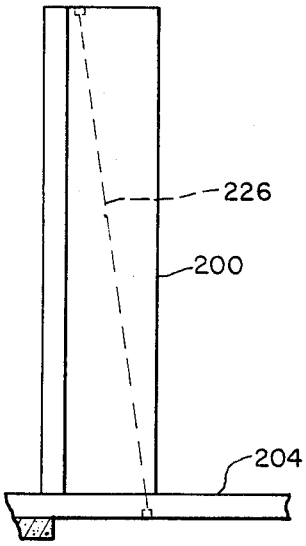
FIG. 27

PRESTRESSED COMPONENT RETAINING WALL SYSTEM

BACKGROUND OF THE INVENTION

The present invention pertains generally to retaining wall systems and particularly to modular retaining wall systems such as those classified in Class 61, subclass 39.

Various methods have been used in the past to construct walls for retaining earth, soil, sand, or other fill, generically referred to as soil. A typical system using tieback elements is disclosed in U.S. Pat. No. 3,922,864 issued to Hilfiker on Dec. 2, 1975. The Hilfiker patent illustrates the typical anchored wall using anchor elements which are connected between the retaining wall and deadman members. Deadman members provide sufficient resistance to horizontal forces of the backfill on the wall to hold the wall in place. If a solid surface is available, such as rock, the anchor elements can be attached to the rock utilizing conventional anchoring techniques.

The disadvantages and limitations of such systems are that a considerable amount of labor is required to install anchors and deadman elements, and to connect the anchor elements with the proper tension to the retaining wall. Moreover, anchor elements are somewhat prone to failure due to occasional defects in the material and progressive weakening due to corrosion of the metal anchor material.

To overcome the disadvantages and limitations of utilizing concrete deadman members and anchors Reinforced Earth Company (RECO) has developed a system using metal strips which function as both anchor elements for a retaining wall and provide stability to the soil mass being retained. These metal reinforcing strips are connected to the retaining wall facia panels to hold the retaining wall in position and to provide stability to the backfill material. Such a system uses both the consistency and the density of the backfill material to produce friction between the metal reinforcing strips and the backfill to render the entire retained mass stable. The consistency of the backfill is controlled by the size distribution of the particles of the backfill, while the density of the backfill is controlled by compaction of the fill as it is placed in position.

The disadvantages and limitations of such a system are that a great deal of expense is involved in obtaining backfill of the proper consistency. If proper materials are available, the size distribution of particles required can be obtained from local sources using crushing and sifting techniques. Otherwise, backfill must be transported from a location where backfill is available having the proper consistency. In both cases, a great deal of expense is involved in obtaining the required backfill at the construction project.

In addition to the costs involved in obtaining the proper backfill, there are significant costs related to the labor intensive process of grading and compacting the backfill for each layer of reinforcing strips to ensure that the requisite friction is provided between the reinforcing strips and backfill to produce a stable soil mass. This labor intensive process increases both costs and time for installation of the the retaining wall.

Additionally, the reinforcing strips used in such a system are subject to the corrosive effect of chemicals present in the backfill material. Although the metal strips can be galvanized to reduce certain oxidation processes, chemicals are present in the backfill material which react with the zinc used in galvanization so as to reduce its effectiveness in a short period of time. Other techniques have also been used to prevent or reduce corrosion of the metal reinforcing strips, including the use of epoxy coatings. Although epoxy coatings are effective against the corrosive chemicals in the backfill, the epoxy coatings are easily scratched during handling, installation, and implementation which exposes the metal strips to the corrosive chemicals. Also, epoxy coatings considerably increase the cost of the metal reinforcing strips, which adds to the overall cost of the Reinforced Earth Company system.

These disadvantages and limitations of prior art systems have been overcome by the modular assembly retaining wall disclosed in U.S. Pat. No. 4,050,254 issued to Meheen et al. on Sept. 27, 1977. The Meheen et al. system utilizes a unitary support structure which has a column and a base unit which are fabricated in a single structure. A web portion between the column and the base members provides added strength to the unitary support structure. Curved wall segments are placed between the support structures so that horizontal forces from the backfill cause the curved wall segments to be placed in compression. This reduces the amount of concrete required in the wall segments and provides a retaining wall with sufficient strength to retain the backfill. The Meheen device uses a unitary support structure for holding the wall segments in place. Horizontal forces produced on the soil retaining panels are transmitted back into the soil mass by the support structure which resists pull out or other unwanted movement of the retaining wall. These horizontal forces result in "overturning moment forces" which tend to overturn or tilt the support structure and the entire retaining wall system. The horizontal base member of the support structure has a specialized shape designed to increase friction between the soil filled earth mass and the horizontal base member, so as to effectively resist pull out of the support structure. The horizontal base member of the support structure is formed with flanges which have a greater width dimension than the width dimension contiguous with the column member of the support structure. The reinforcing web between the column and base of the support structure is disposed on the interior angle formed by the column and base members to form a unitary support structure st the time of fabrication. The unitary support structure is capable of withstanding "bending moment forces" produced by the backfill, i.e. forces from the backfill which cause internal stresses on the elements of the unitary support structure.

The disadvantages and limitations of the Meheen et al. device are that specialized molds i.e., concrete forms, are required for fabrication. This greatly increases the cost of the Meheen et al. retaining wall system since the concrete forms must be specially fabricated by a concrete precasting plant for the particular retaining wall system in which they are being employed. Increased initial capital investment resulting from the necessity for specialized forms for producing the support structure and the curved panels increases the overall cost of the retaining wall segment system. Although the modular design concept of fabricating components in a concrete precasting plant eliminates many of the costs incurred in pouring concrete in the field, these cost savings are offset by the necessity for specialized forms and difficulties of transporting the modular components from the precast concrete plant to the installation site, especially the support structure. Transportation of the support structure is difficult due to the cumbersomeness and awkwardness of the units. Roadway height and width requirements have limited the size and number of units which can be transported. The support structures are top heavy, have considerable weight and necessitate the use of large trucks which are capable of only transporting a few units at a time. This increases transportation costs, and also increases overall costs of the retaining wall system.

SUMMARY OF THE INVENTION

The disadvantages and limitations of the prior art have been overcome by the present invention which provides a modular retaining wall system having separate column member means and base member means which are formed from standard, precast concrete Tee beam forms commonly available in precast concrete plants. The base and column members are joined by post-tensioning devices which run along the length of the base and column members and impart increased strength to these members so as to reduce size requirements of the base and column members. Leg portions of the base and column members form a web portion along the interior angle of the support structure which increases the leverage of the connecting junction so as to form a unitary structure capable of withstanding moment bending forces.

The modular design of the system allows the individual pieces to be shipped prior to assembly in a simple and easy manner from a precasting concrete plant where the support structure is formed from commonly available precast concrete forms. This greatly reduces expenses in fabrication and shipping since specialized forms are not required and individual components of the modular system can be easily transported by small truck. Flat prestressed wall segments are used between the support structures. Flat prestressed wall segments can be mass produced in precasting concrete plants in a simple and inexpensive manner. Prestressing of the wall segments reduces the amount of material required to provide equivalent strength of much larger wall segments, so as to further reduce fabrication and shipping costs. The support structure of the present invention utilizes a foot portion formed from the base member which increases the lever arm of the base member to offset overturning moment forces. Overturning moment forces are also offset by counterbalancing slabs disposed on the base member, by cross-tie elements between opposing walls, and by support devices disposed under the foot portion. Bearing pressures on the foundation are controlled by flanges on the base member and by counterbalance slabs disposed in the base member which engage additional backfill and tend to offset overturning moment forces. The present invention therefore eliminates the use of poured concrete in the field and utilizes locally available backfill material, since the consistency and density of the backfill is not a limiting factor for utilization of the present invention. The modular components can be mass produced in an inexpensive manner in a precasting plant using standard concrete precast forms and easily shipped as separate components and assembled at the installation location.

The present invention may therefore comprise a retaining wall system which can be assembled at an installation location from a plurality of separate modular components comprising: precast column member means having a base portion and a leg portion adjoining the base portion to form a cross-sectional Tee configuration; separate precast base member means having a base portion and a leg portion adjoining the base portion to form cross-sectional Tee configuration, the base portion extending beyond the leg portion in a transverse direction to form a flange, the leg portion and the flange having a surface area which engages sufficient backfill to produce resisting forces which, in combination with the weight of the base member means, are sufficient to overcome overturning moment forces produced by the backfill; post-tensioning means for joining the precast column member means and the separate precast base member means at the installation location so that the leg portions of the base member means and the column member means are joined to form a web portion which provides sufficient stability to produce a unitary support structure capable of overcoming bending moment forces produced by backfill on the support structure, and for imparting increased strength to the base member means and the column member means to reduce size and weight of the support structure.

The present invention may further include a foot portion formed from a lengthwise extension of the base member means beyond the column member means by an amount sufficient to reduce vertical forces at the foot portion resulting from overturning moment forces to design level pressures. The present invention may also comprise wall segments means disposed and supported by the base portion of the column portion means for retaining backfill, which can be fabricated from precast, prestressed flat concrete slabs, counterbalancing slab means disposed on the base member means which decreases the length of the base member means by increasing vertical forces on the base member means to offset overturning moment forces, support means disposed under the foot portion for offsetting overturning moment forces which can comprise a concrete slab, concrete post, or a continuous footer, cross-tie means disposed between and coupled to opposing column member means to reduce overturning moment forces with sleeves to protect from corrosion, anchor means coupled to column member means with sleeves to protect from corrosion, and facia panel means for providing an external appearance of a continuous uniform slope between a plurality of adjacent retaining wall units.

The present invention may also comprise a support structure for retaining a wall system comprising: precast column member component means having a base portion and a leg portion adjoining the base portion to form a cross-sectional Tee configuration; precast base member component means forming a substantially flat slab; post-tensioning means disposed laterally through the precast column member component means for joining the base member means and the column member means such that the cross-sectional Tee configuration provides sufficient stability when disposed on the base member means to provide a unitary support structure capable of withstanding bending moment forces produced by backfill, and for imparting increased strength to the column member means to reduce size and weight of the support structure.

The present invention may also comprise a method of forming a support structure for a retaining wall comprising: forming a precast column member component from a precast concrete Tee beam form; forming a precast base member component from a precast concrete Tee beam form; disposing post-tensioning means along the length of the precast column member component and the precast base member component; joining the precast column member component and the precast base member component at a substantially normal angle with aid post-tensioning means; applying a post-tensioning force to the post-tensioning means to secure the precast column member component and the precast base member component together with sufficient strength to withstand bending moment forces produced by backfill and impart increased strength to the precast column member component and the precast base member component.

The present invention may also comprise a retaining wall system formed from a plurality of modular precast components assembled at an installation location comprising: wall segment means for retaining backfill material; flange means disposed on an upper portion of the wall segment means for retaining the wall segment means from movement by forces produced by the backfill material; continuous footer means disposed under the wall segment means for dispersing forces produced by the backfill material on the wall segment means over a predetermined surface area sufficiently large to reduce bearing pressure on the continuous footer means to a level sufficiently low to meet design bearing pressure limits; retaining means disposed on the continuous footer means adjacent the wall segment means for preventing movement of the wall segment means in response to forces produced by the backfill; base member means coupled to the retaining means for engaging vertical forces produced by the backfill; column member means coupled to the base member means and the flange means for transmitting vertical forces produced by the backfill to the flange means to retain the flange means in response to forces produced by the backfill on the wall segment means.

The present invention may also comprise a retaining wall system formed from a plurality of precast components assembled at an installation location comprising: wall segment means for retaining backfill material; column member means having a base portion and two leg portions adjoining the base portion to form a double Tee cross-sectional configuration; base member means forming a substantially flat slab; post-tensioning means disposed laterally through the two leg portions of the column member means for joining the base member means and the column member means such that the double Tee cross-sectional configuration provides sufficient stability when disposed on the base member means to produce a unitary support structure capable of withstanding bending moment forces produced by backfill, and for imparting increased strength to the column member means to reduce size and weight of the support structure; whereby the base portion of the column member means reduces the size of the wall segment means to reduce overall costs of the retaining wall system.

OBJECTS OF THE INVENTION

It is therefore an object of the present invention to provide an improved retaining wall system.

It is also an object of the present invention to provide an improved retaining wall system which is inexpensive and easy to fabricate and implement.

Another object of the present invention is to provide a retaining wall device which can be shipped in incremental parts and assembled on location.

Another object of the present device is to provide a unitary support structure for a retaining wall system which can be assembled at an installation location from a plurality of separate modular components.

Another object of the present device is to provide a unitary support structure to be used in spaced relationship with similar unitary support structures and prestressed wall segments extending between the support structures for retaining soil in a retaining wall system which can be assembled at an installation location from a plurality of separate modular components.

Another object of the present invention is to provide a modular retaining wall system which can be mass produced in a concrete precasting plant and transported in incremental pieces and assembled on location.

Another object of the present invention is to provide a method of forming a support structure for a retaining wall.

Additional objects, advantages and features of the present invention are set forth in part in the description which follows and can be understood by those skilled in the art upon examination of this disclosure or may be learned by practice of the invention. The objects and advantages of the invention may be realized and obtained by means of the instrumentalities and combinations particularly pointed out in the appended claims.

BRIEF DESCRIPTION OF THE DRAWINGS

An illustrative and presently preferred embodiment of the invention in the accompanying drawing in which:

FIG. 3 is schematic cut-away view of one type of post-tensioning device which can be used in accordance with the present invention.

FIG. 4 is a schematic side elevation of the device illustrated in FIG. 2.

FIG. 5 is a schematic front elevation of the device illustrated in FIG. 4.

FIG. 6 is a schematic plan view of the device illustrated in FIGS. 4 and 5.

FIG. 24 is a plan view of the embodiment illustrated in FIG. 23.

FIG. 25 and 26 are cross-sectional views of FIG. 24 illustrating alternate modification of the base member.

FIG. 27 shows an alternative manner of positioning the past-tensioning device in the column member.

DETAILED DESCRIPTION OF THE INVENTION

Figure 1:
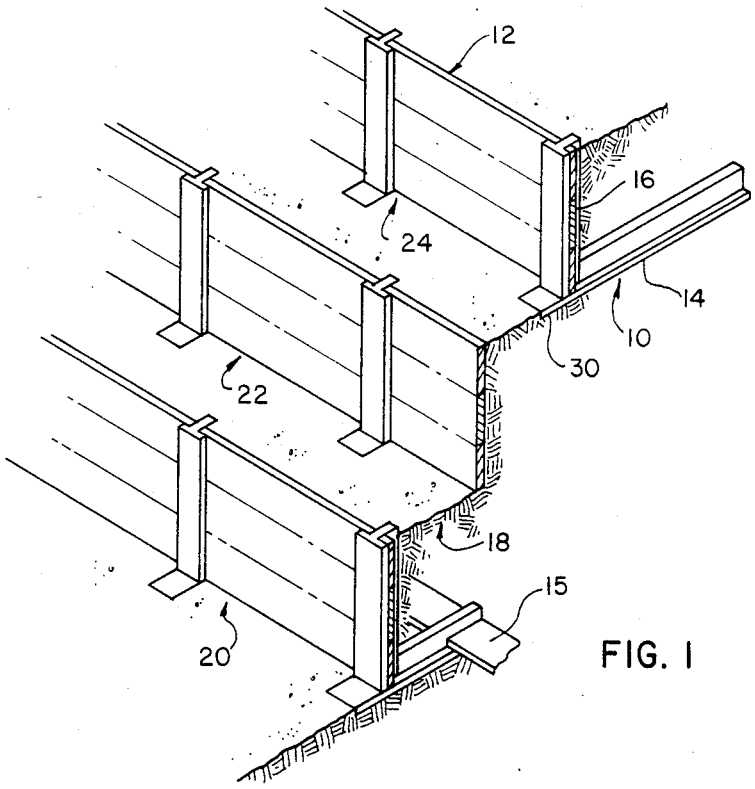
FIG. 1 is a schematic isometric view of a tiered retaining wall system utilizing an embodiment of the present invention.

FIG. 1 is a schematic isometric view of the retaining wall system employing an embodiment of the present invention. As illustrated in FIG. 1, a plurality of support structures 10 are employed in a spaced relationship with prestressed wall segments 12 extending between support structures 10 to retain soil 18 along an embankment. Support structures 10 are formed from a base member 14 and a column member 16 which are joined together by post-tensioning means at the installation location. Base members 14 and column members 16 can be mass produced in a precasting concrete plant and transported separately for assembly at the installation location. FIG. 1 illustrates a retaining wall system utilized in a tiered configuration for retaining soil along an embankment. Each of the retaining wall tiers 20, 22, and 24 are constructed of modular components to eliminate the time consuming and expensive process of pouring concrete in the field.

Figure 2:
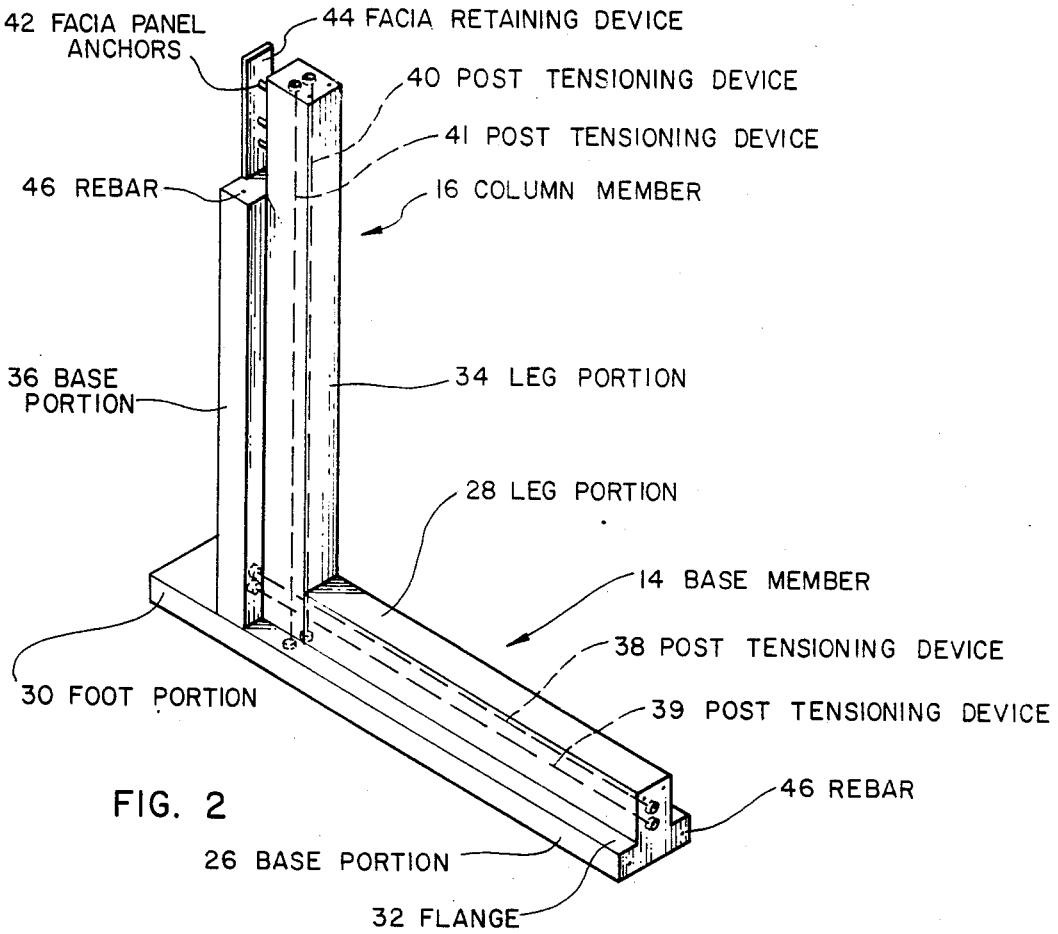
FIG. 2 is a schematic isometric view of a support structure illustrated in the tiered wall of in FIG. 1.

FIG. 2 is a schematic isometric view of the support structure of the embodiment illustrated in the tiered wall of FIG. 1. Support structure 10 has a base member 14 having a base portion 26 and a leg portion 28 adjoining the base portion at a substantially normal angle and substantially centered on the base portion 26. The base portion 26 extends beyond leg portions 28 in a lengthwise direction beyond column means 16 to form a foot portion 30. The base portion 26 also extends beyond leg portion 28 in a transverse direction to form a flange 32 such that base member 14 has a cross-sectional Tee configuration.

Column 16 is formed from a base portion 36 and a leg portion 34 adjoining base portion 36 at a substantially normal angle and substantially centered on the base portion 36. Leg portion 34 extends beyond base portion 36 in a lengthwise direction by a predetermined distance as illustrated in FIG. 2. Base portion 36 extends beyond leg portion 34 in a transverse direction by a predetermined distance such that column member 16 has a cross-sectional Tee configuration.

Post-tensioning devices 38,39 are disposed along the length of leg portion 28 of base member 14. Post-tensioning devices 38,39 extend through leg portion 34 and base portion 36 of column 16 to secure column 16 to base member 14 in a horizontal direction. Post-tensioning devices 40,41 are disposed along the length of leg portion 34 of column 16 and extend through foot portion 30 of base member 14 to secure column 16 to base member 14 in a vertical direction. Although only two post-tensioning devices have been shown through each member, any number of post-tensioning devices can be used to impart the requisite strength to the members and to the coupling of the members.

Facia panel anchors 42 are disposed in a portion of the leg portion 34 which extends beyond base portion 36 of column 16. Facia panel anchors 42 can comprise bolts or other anchor devices coupled to leg portion 34. Panel retaining device 44 is coupled to the support structure 10 by facia panel anchors 42. Facia panels are disposed between leg portion 34 and facia retaining device 44, resting on the top of base portion 36. Facia panels are held in place by coupling of facia retaining device 44 against the facia panels. Rebar 46 provides added strength to base and column members.

FIG. 3 is a schematic cross-sectional diagram of a typical post-tensioning device which can be used in accordance with the present invention. As illustrated in FIG. 3, a post-tensioning rod 48 is disposed in the post-tensioning holes formed in the structure to be post tensioned. Post-tensioning nut 54 is placed in a position to secure post-tensioning rod 48 at one end. The desired amount of post-tensioning force is then applied to post-tensioning rod 48 from the other end and post-tensioning nuts 50, 52 are secured in position. After post-tensioning nuts 50, 52 are secured in position, grout is inserted through grouting tubes 54, 56 to cement post-tensioning bar 48 in position so that the entire assembly becomes a unitary post-tensioned structure. Post-tensioning forces are therefore transmitted through the grout and nuts 50, 54 to the base and column members or other members being post-tensioned to increase the strength of these members.

FIG. 4 is a schematic side view of a support structure illustrated in FIG. 2. As illustrated in FIG. 4, post-tensioning rods 38, 39 are disposed through leg portion 28 of base member 14, and through leg portion 34 and base portion 36 of column member 16. Post-tensioning rod 38 is secured to column 16 at recessed hole 62 while post-tensioning bar 39 is secured to column 16 at recessed hole 64. Post-tensioning rods 38, 39 are coupled to base member 14 at recessed holes 68, 66, respectively. Post-tensioning rods 38, 39 secure the base member 14 to column 16 in a horizontal direction while post-tensioning rod 40, 41 ( FIG. 5) secure column 16 to foot portion 30 in a vertical direction. Post-tensioning rod 40 is coupled with foot portion at recessed hole 74 and to column member 16 at recessed hole 76. Post-tensioning rods 38, 39 impart increased strength to base member 14 while post-tensioning rod 40, 41 impart increased strength to column member 16. This reduces the required size of the column and base members for a predetermined strength. Leg portions 34, 28 are consequently joined along the interior angle of the support structure as illustrated in FIG. 4 to form a web portion which provides sufficient stability to provide a unitary support structure which is capable of withstanding bending moment forces produces by backfill. Rebar 82 provides added strength to foot portion 30 while rebar 84 increases strength of the coupling between base portion 26 and leg portion 28 of base member 14.

FIG. 5 is a front elevation view of the support structure shown in FIG. 2. As shown in FIG. 5, post-tensioning bars 40, 41 extend lengthwise through column member 16 and through foot portion 30 of base member 14. Post-tensioning rod 40 is anchored in column member 16 at recessed hole 76 and foot portion 30 at recessed hole 74, while post-tensioning rod 41 is anchored in column member 16 at recessed hole 80 and foot portion 30 at recessed hole 78.

FIG. 6 is a plan view of the support structure as illustrated in FIG. 2. As illustrated in FIG. 6, foot portion 30 extends beyond column member 16 by a predetermined distance. FIG. 6 also illustrates panel retaining device 44, facia panel anchors 42, base portion 36 of column member 16, leg portion 34 of column member 16 and base 26 and leg 28 portions of base member 14.

Figure 7:
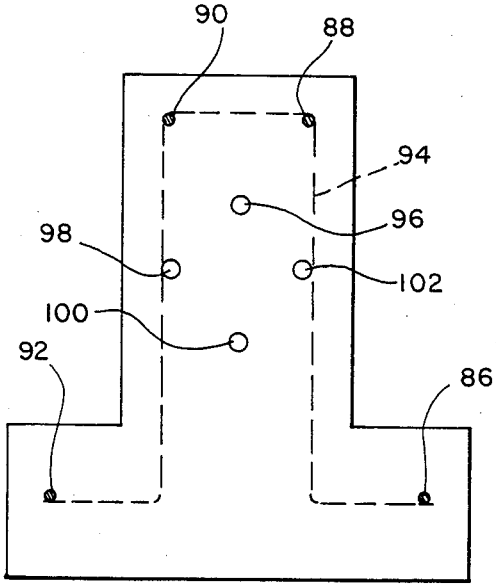
FIG. 7 is a cross-sectional view of the device illustrated in FIG. 4.

FIG. 7 is a cross-sectional diagram of the base member 14 and column member 16 as illustrated in FIG. 4. As illustrated in FIG. 7, base member 14 and column 16 have a similar cross-sectional configuration. Rebar 86, 88, 90, 92 are disposed along the length of the base and column members to provide increased strength. Rebar 94 is also disposed in the base member and column member to provide added strength to the union of the base portions and leg portions.

Figure 8:
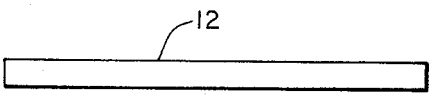
FIG. 8 is a schematic plan view of the prestressed wall segment utililzed in accordance with the present invention.

FIG. 8 is a schematic plan view of the prestressed wall segments 12 used to retain backfill material. As illustrated in FIG. 8, the present invention utilizes a flat, prestressed panel which can be mass produced in a concrete precasting plant.

Figure 9:
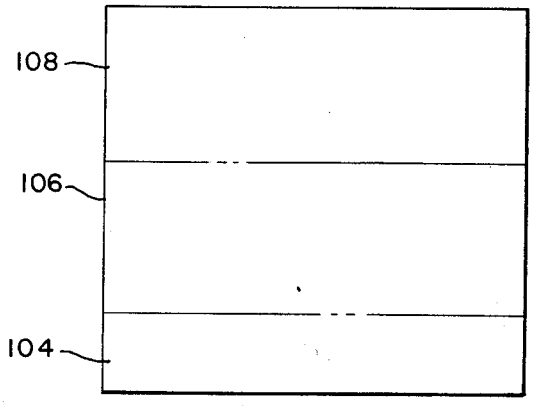
FIG. 9 is a schematic front elevation of the wall segments illustrated in FIG. 8.

FIG. 9 is a front elevation view of a plurality of wall segments 104, 106, 108 which can be used in a stacked, vertical configuration to retain backfill, as illustrated in FIG. 1. The prestressed wall segments 12, illustrated in FIGS. 8 and 9, are formed from a flat concrete slab which has been prestressed to impart added strength to resist horizontal forces produced by backfill. Prestressing reduces the amount of concrete required to maintain the required strength of the wall segments while simultaneously reducing fabrication and transportation costs. Prestressing can be provided by pretensioning the slabs during fabrication, or by post-tensioning after fabrication. Pretensioned wall segments can be formed using an extruded process in a pre-casting yard employing a precasting bed of 1,000 feet or longer. Large machinery is used to pretension strand in the bed prior to pouring of concrete. Concrete is then poured around the strand and allowed to cure while the pretensioning force is maintained. After the panels are cured, the pretensioning machines are released and the panels are cut to a desired length and width. The wall segments can then be deployed with the support structures as illustrated in FIG. 1.

In operation, the embodiment illustrated in FIGS. 1–9 utilizes a base portion 14 and a column portion 16 which are assembled on location with post-tensioning devices to form a unitary support structure 10. A plurality of unitary support structures are placed in spaced relationship such that wall segments 12 can be placed in position to abut against leg portion 34 and aligned with base portion 36 of column member 16. Backfill material 18 is then placed behind the wall panels such that the horizontal forces produced by the backfill 18 cause panel segments 12 to impart bending moment forces and overturning moment forces on unitary support structure 10. Base portion 14 has a horizontal surface area sufficiently large to engage enough backfill to overcome overturning moment forces transmitted to the column member by horizontal forces backfill 18. Foot portion 30 extends beyond column 16 to provide added support to offset overturning moment forces by increasing the lever arm of base member 14. Additionally, foot portion 30 reduces toe pressures caused by vertical forces resulting from bending moment forces by increasing the surface area at the foot portion of the unitary support structure 10. This allows use of retaining walls of greater height which are capable of retaining greater amounts of backfill.

Figure 28:
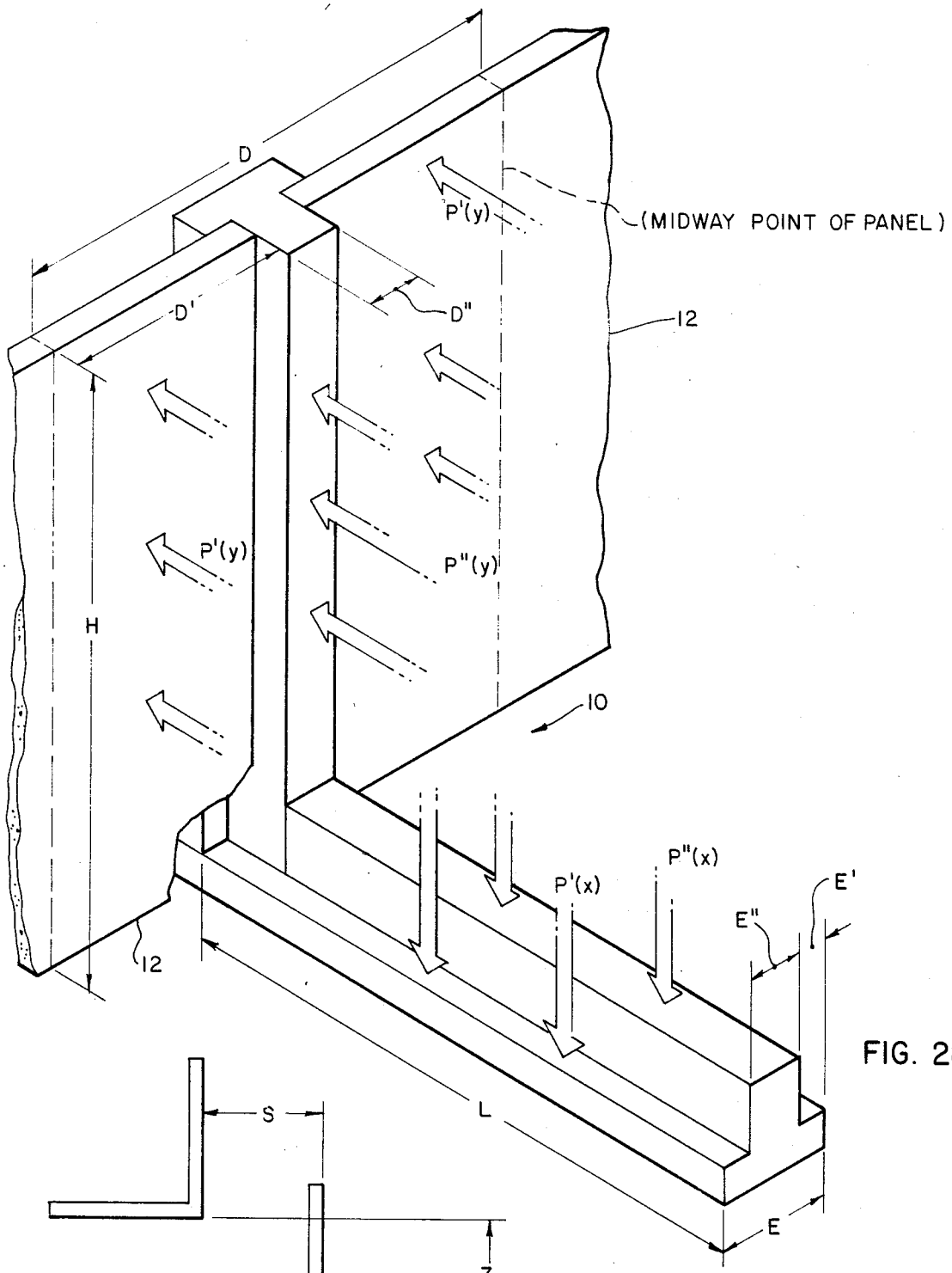
FIGS. 28 and 29 illustrate various parameters of the system.
Figure 29:
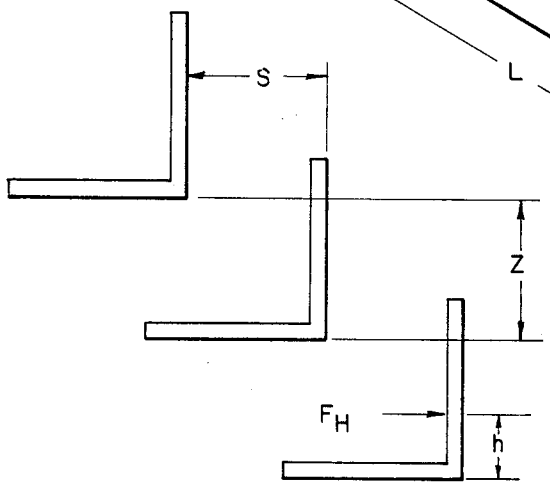

Referring to FIGS. 28 and 29, various parameters are disclosed which pertain to the tiered retaining wall system of the present invention. Pertinent parameters are defined as follows:

$F_h$=total horizontal force from backfill;
$F_v$=resisting force produced by backfill on base member 14;
$F_{om}$=overturning moment force;
$F_b$=bending moment force;
P(y)=horizontal pressure produced by backfill at depth y;
P(x)=vertical pressure produced by backfill at distance x;
$\gamma$=unit weight of soil;
Z=vertical depth of soil;
S=setback between tier layers;
N=total number of tier layers;
H=height of retaining wall;
D=center to center spacing of wall segments;
E=total width of base member;
$\phi$=internal friction angle of the backfill material.

Overturning moment forces ($F_{om}$) are determined from horizontal forces ($F_h$) produced by the backfill. $F_h$ is determined as follows:

$$F_h = \int_0^h D \cdot P(y)dy \tag{1}$$

In other words, the horizontal force ($F_h$) is the integral of horizontal pressures for each retaining wall unit from zero to H multiplied by the total horizontal width (D) over which the pressures are applied. Width D′ is the width of base portion 36 while D″ is half of the width of each wall segment 12 adjacent the support structure 10. Backfill adjacent leg portion 34 produces pressure P″ (y) against leg portion 34. The total horizontal pressure P(y) therefore equals 2P′(y)+P″(y).

The horizontal pressure [P(y)], i.e., the total pressure acting against column member 16 in a horizontal direction, can be determined from the vertical pressure [P(x)], i.e., the pressure acting against base member 14 in a vertical direction, in the following manner:

$$P(y) = \frac{1 - \sin\phi}{1 + \sin\phi} P(x) \tag{2}$$

The vertical pressure P(x) for the tiered wall of the present invention is determined as follows:

$$P(x) = \sum_{i=1}^{N} \frac{\gamma Z[L - (N-1)S]}{L + (N-1)S} \tag{3}$$

The overturning moment force ($F_{om}$can then be determined as follows:

$$F_{om} = F_n \cdot h \tag{4}$$

where the distance from the base to the centroid of the distribution of pressures along the column member 16.

The bending moment force ($F_b$) at any point (c) along column member 16 can be determined as follows:

$$F_b = \int_c^h D \cdot P(y)dy \quad (5)$$

The resisting force ($F_v$), i.e., the force of the backfill acting upon base member 14, can be determined as follows:

$$F_v = \int_0^L E \cdot P(x)dx \quad (6)$$

The addition of counterbalancing slabs increases the effective horizontal surface area of base member 14 so that P(x) not only becomes the pressure exerted against the horizontal surfaces area of base member 14 from backfill, but also pressure transmitted against horizontal surfaces of the counterbalancing slabs from backfill, which is transmitted to base portion 26 of base member 14.

Figure 10:
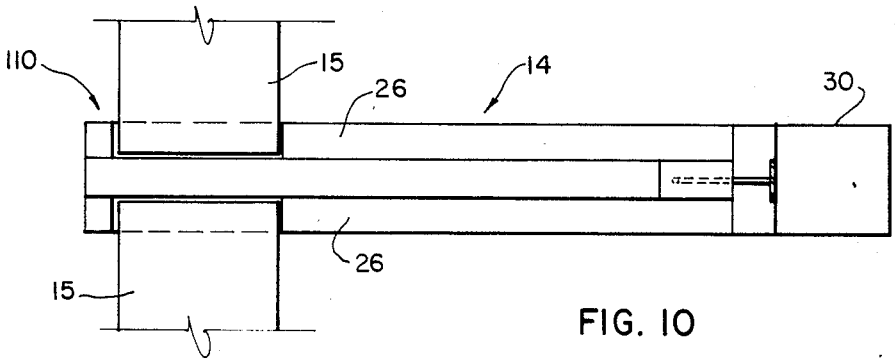
FIG. 10 is a schematic plan view of the support structure illustrated in FIGS. 4–6 used in conjunction with counterbalancing slabs.

FIG. 10 is a schematic plan view of the unitary support structure illustrated in FIG. 2 deploying counterbalancing slab 15. FIG. 1 also illustrates the use of a counterbalancing slab 15. As illustrated in FIG. 10, the counterbalancing slabs 15 are disposed on a tail portion 110 of base member 14 which is opposite foot portion 30. Counterbalancing slabs 15 are recessed in base portion 26 of base member 14 to secure counterbalancing slabs 15 on base member 14. Additionally, recessing of counterbalancing slabs in base portion 26 causes counterbalancing slab 15 to resist horizontal sliding forces in a lengthwise direction along base member 14. Counterbalancing slabs 15 also offset overturning moment forces by providing additional vertical forces on base member 14 resulting from the weight of the counterbalancing slab and vertical forces from backfill engaged by the horizontal surface area of counterbalancing slab 15.

Figure 11:
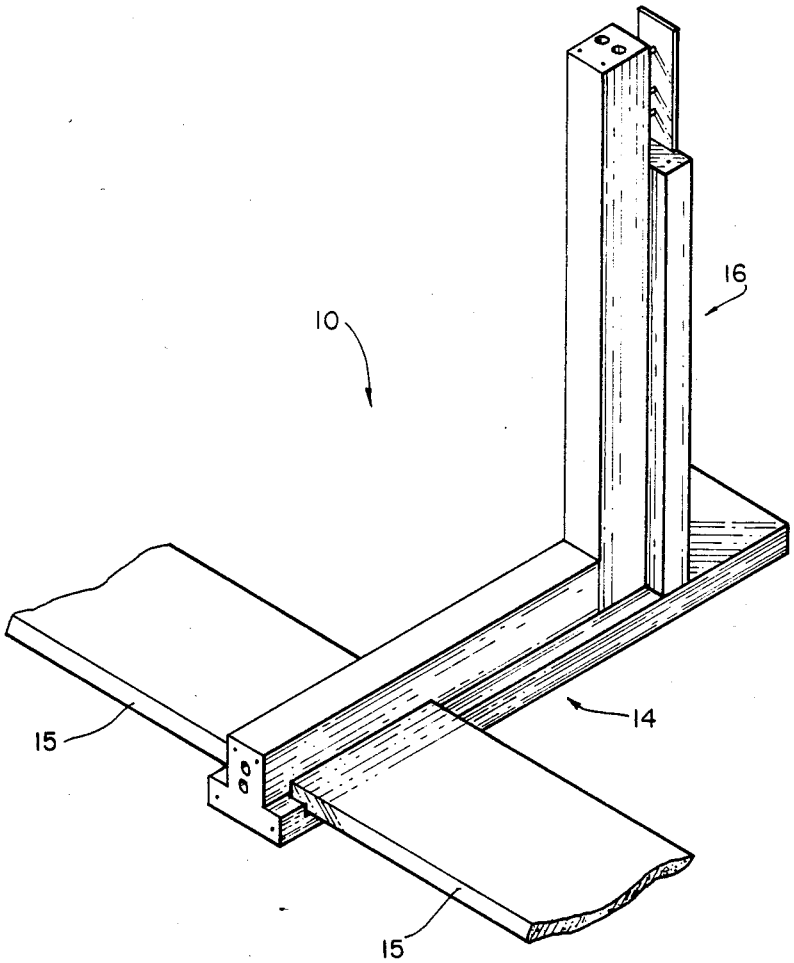
FIG. 11 is a schematic isometric view of the device illustrated in FIG. 10.

FIG. 11 is a schematic isometric diagram of the unitary support structure 10 utilizing counterbalancing slabs 15. Counterbalancing slabs 15 can be disposed securely between adjacent unitary support structures 10, in the same manner as wall segments 12 to prevent slippage after installation. Since counterbalancing slabs 15 are capable of offsetting large bending moment forces, much shorter base member 14 can be used so as to substantially reduce fabrication and shipping costs. Additionally, column member means 16 can be made somewhat longer because of the increased offsetting of bending moment forces by counterbalancing slabs 15 such that the retaining wall system illustrated in FIG. 1 can retain greater amounts of fill at each tier level.

Figure 12:
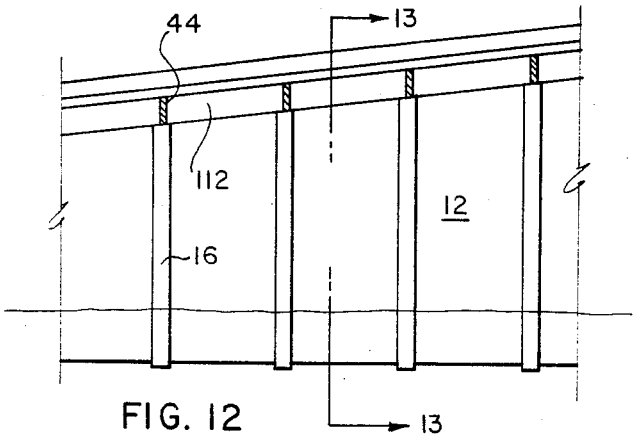
FIG. 12 is a schematic front elevation of an additional embodiment of the present invention.

FIG. 12 is a schematic front elevation view of an embodiment of the present invention utilizing cross-ties. FIG. 12 also illustrates the manner in which facia panels 112 are utilized in the device of the present invention.

Figure 13:
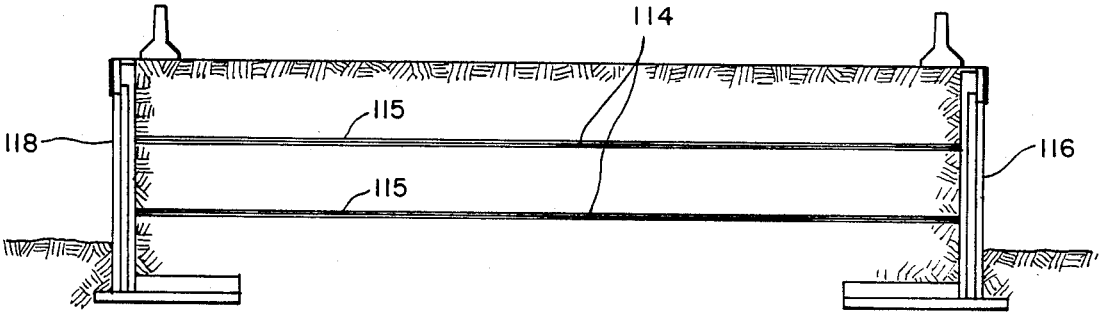
FIG. 13 is a cross-sectional view of the device illustrated in FIG. 12.

FIG. 13 is a cross-sectional diagram of the device illustrated in FIG. 12. As illustrated in FIG. 13, cross-tie members 114 are utilized to couple opposing column members 116, 118 to offset bending moment forces and overturning moment forces. Cross-tie members 114 may comprise cables or bars which have been protected against corrosion. The cable or bar cross-tie members are disposed within protective sleeves so that the cross-tie members are not exposed directly to the potentially corrosive action of chemicals in the backfill. The Reinforced Earth Company system cannot employ a protective sleeve such as used in the present invention since the metal strips must be in direct contact with the backfill material to provide the requisite friction to establish stability. Consequently, the present invention is capable of providing a cross-tie system with much greater protection against corrosion by employing a protective sleeves 115 around cross-ties 114.

Horizontal movement of the wall from forces produced by backfill can be controlled by post-tensioning of the cross-tie members at column members 116, 118. Cross-tie members 114 can be installed at or a few inches below the backfill such that heavy equipment can be employed during installation. Additionally, the vertical wall system illustrated in FIGS. 12 and 13 can be utilized to fabricate vertical walls having a substantial height, since bending moment forces and overturning moment forces are effectively offset by the cross-tie members 114. The vertical wall system illustrated in FIG. 13 has many of the same advantages of the tiered wall system illustrated in FIG. 1, such as, easily obtainable backfill specifications, construction with standard crew and equipment, a variety of wall face architecture, and low cost.

Figure 14:
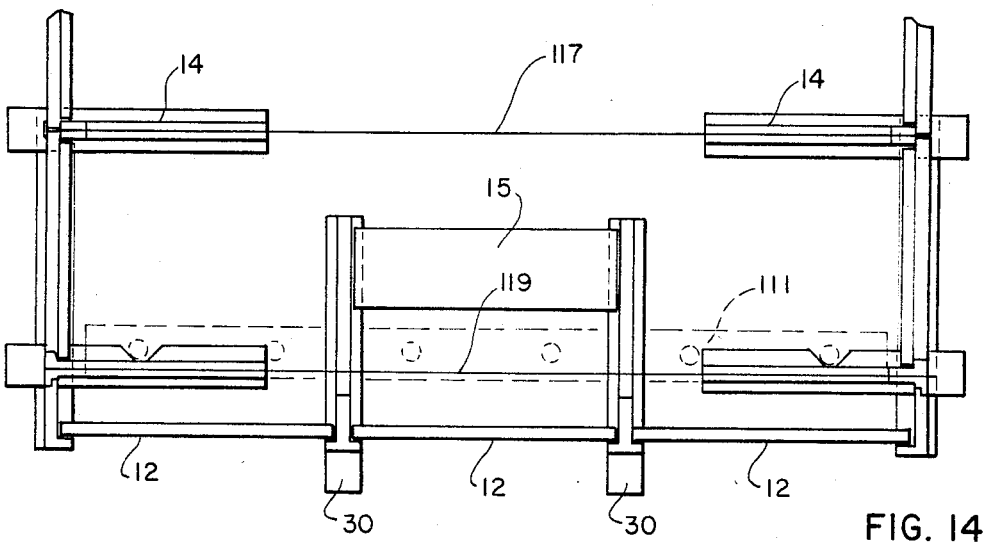
FIG. 14 is a schematic plan view of the present invention employed in conjunction with a bridge abutment.
Figure 15:
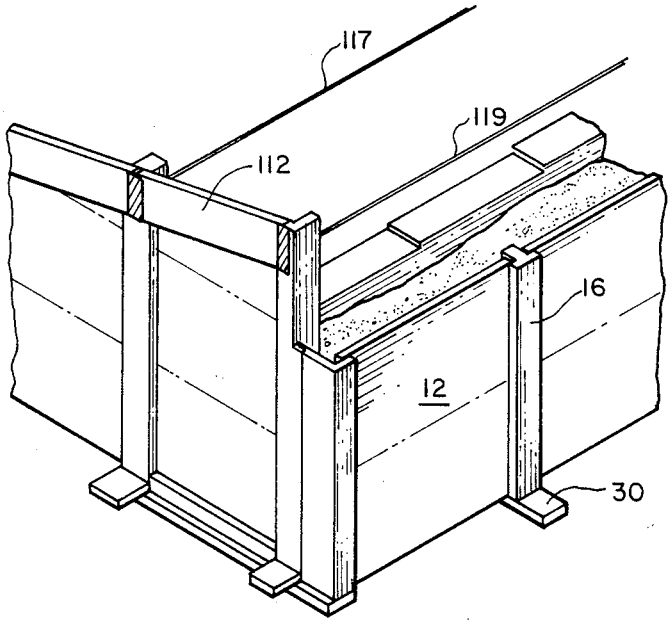
FIG. 15 is a schematic isometric view of the device illustrated in FIG. 14.

FIGS. 14 and 15 illustrate the manner in which the present invention may be utilized as a retaining wall in conjunction with a bridge abutment. Each of the unitary support structures 10 employ a foot portion 30 to offset overturning moment forces. A counterbalancing slab 15 is utilized between support structures at the end of the abutment to offset the additional overturning moment forces and to insure adequate strength. Facia panels 112 are employed along the top surface to give an aesthetic appearance to the retaining wall. Cross-tie members 117 and 119 function to offset both bending moment forces and overturning moment forces.

Figure 16:
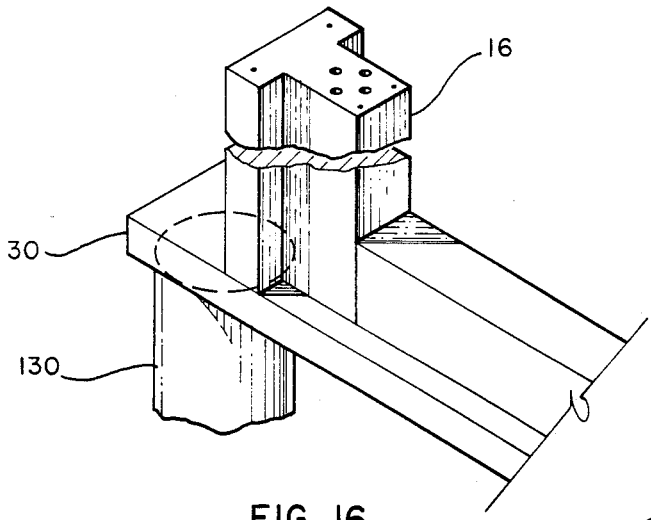
FIG. 16 is a schematic isometric view of the support structure illustrated in FIGS. 4–6 utilizing a column support.
Figure 17:
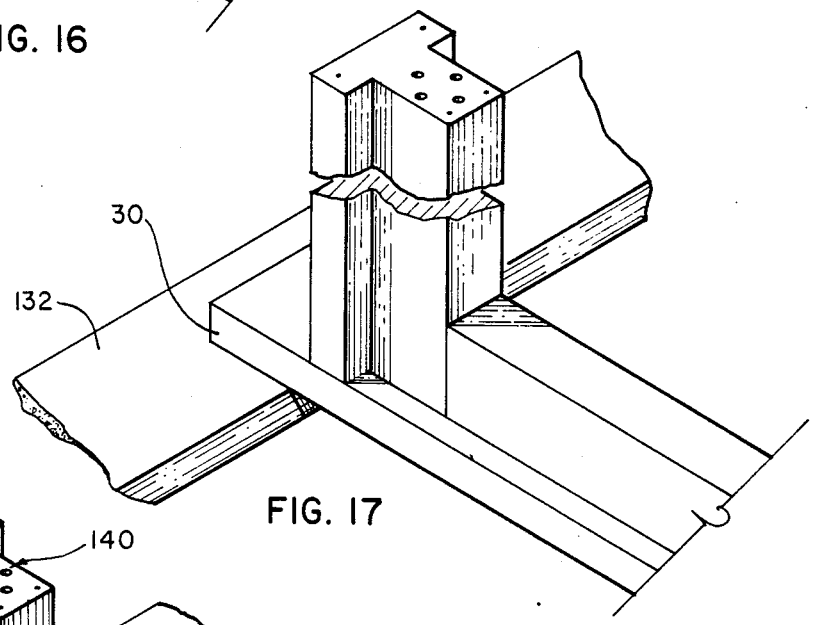
FIG. 17 is a schematic isometric view of the support structure illustrated in FIGS. 4–6 utilizing a continuous footer.

FIGS. 16 and 17 are schematic isometric views of the present invention utilizing a support disposed beneath foot portion 30. As illustrated in FIG. 16, a column member 130 is utilized as a support structure under foot portion 30 to offset toe pressure produced by overturning moment forces on column member 16 which may exceed design level pressures for the soil. In other words, because of soil loading limitations or other factors, such as size or space requirements of implementation of the present system, a support structure such as column 130 may be utilized to provide sufficient support to offset overturning moment forces. FIG. 17 illustrates the use of a slab support 132 disposed under foot portion 30 to provide support in the same manner as column 130 of FIG. 16. Slab support 132 can comprise a continuous footer element which may be fabricated as a modular component at a concrete precasting plant. Again, the continuous footer 132 can be mass produced in an extruded process, such as described above, and cut to a desired length. Continuous footer 132 can be fabricated as a reinforced concrete slab or as a prestressed component.

Figure 18:
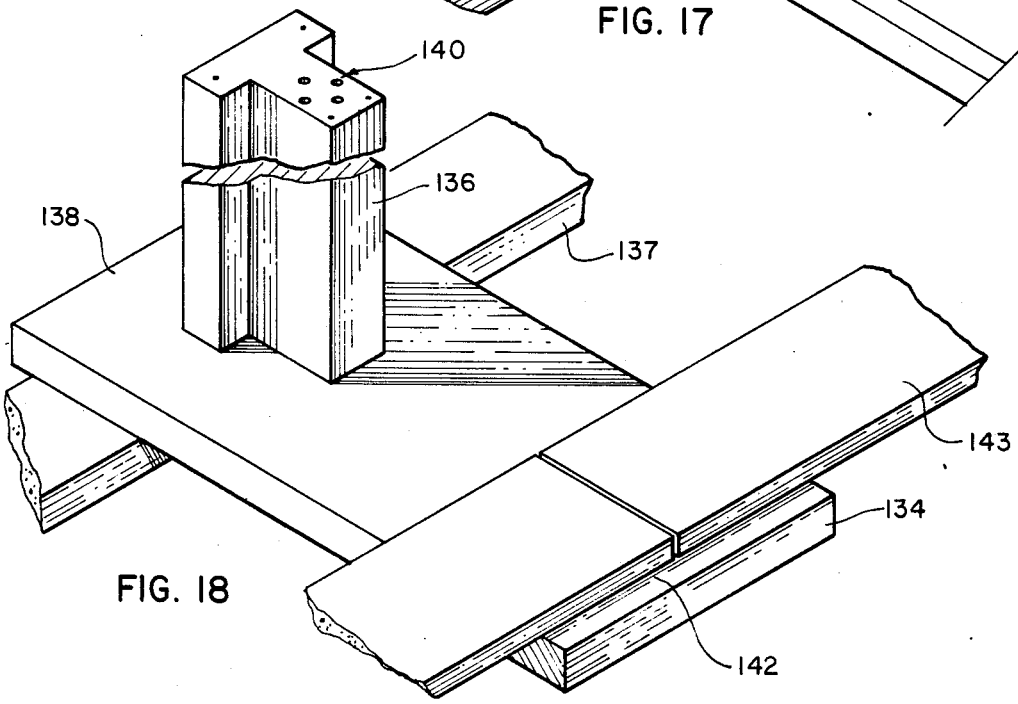
FIG. 18 is a schematic isometric view of an additional embodiment of the present invention.

FIG. 18 is a schematic isometric diagram of an additional embodiment of the present invention which utilizes a concrete slab 134 as a base member. Concrete slab 134 may comprise a standard reinforced concrete slab or a prestressed slab having a greater strength, and smaller size and weight than a standard reinforced concrete slab. Column member 136 is mounted in a position on concrete slab 134 such that the lever arm of the base member 134 is increased by an amount sufficient to decrease overturning moment forces at foot portion 138 so that the total vertical forces at foot portion 138 produce pressures which are less than design level pressures. In other words, the total vertical forces at foot portion 138 produce bearing pressures beneath the foot portion 138 which the foundation soil is capable of supporting. The post-tensioning rods used to join the two members are disposed through post-tensioning holes 140 in column 136 and through similar post-tensioning holes in slab 134 which align with post-tensioning holes 140. Post-tensioning of column 136 and base member 134 provides a unitary support structure capable of withstanding bending moment forces and imparts added strength to column member 136 to reduce the required size and weight of the column member 136. The embodiment of FIG. 18 can also utilize a continuous footer 137 and counterbalancing slabs 143, such as described above to further offset overturning moment forces.

An advantage of the embodiment illustrated in FIG. 18 is that the concrete slab 134 used as the base member can be mass produced in large concrete pre-casting plants using an extruded process. Large beds of 1,000 feet or more are used to produce pretensioned concrete slabs which can be cut to a desired length after curing. This further reduces cost over the use of standardized concrete Tee forms. Additionally, concrete slab 134 has a large horizontal surface area so that a large amount of backfill is engaged to offset overturning moment forces. This further reduces the required size and length of a base member 134 and consequently results in greater cost savings. The disadvantage of the embodiment of FIG. 18 is the loss of leverage in the coupling of post-tensioning devices, such as post-tensioning devices 38, 39, through a leg portion 28 of base member 14 as illustrated in FIG. 2.

Figure 19:
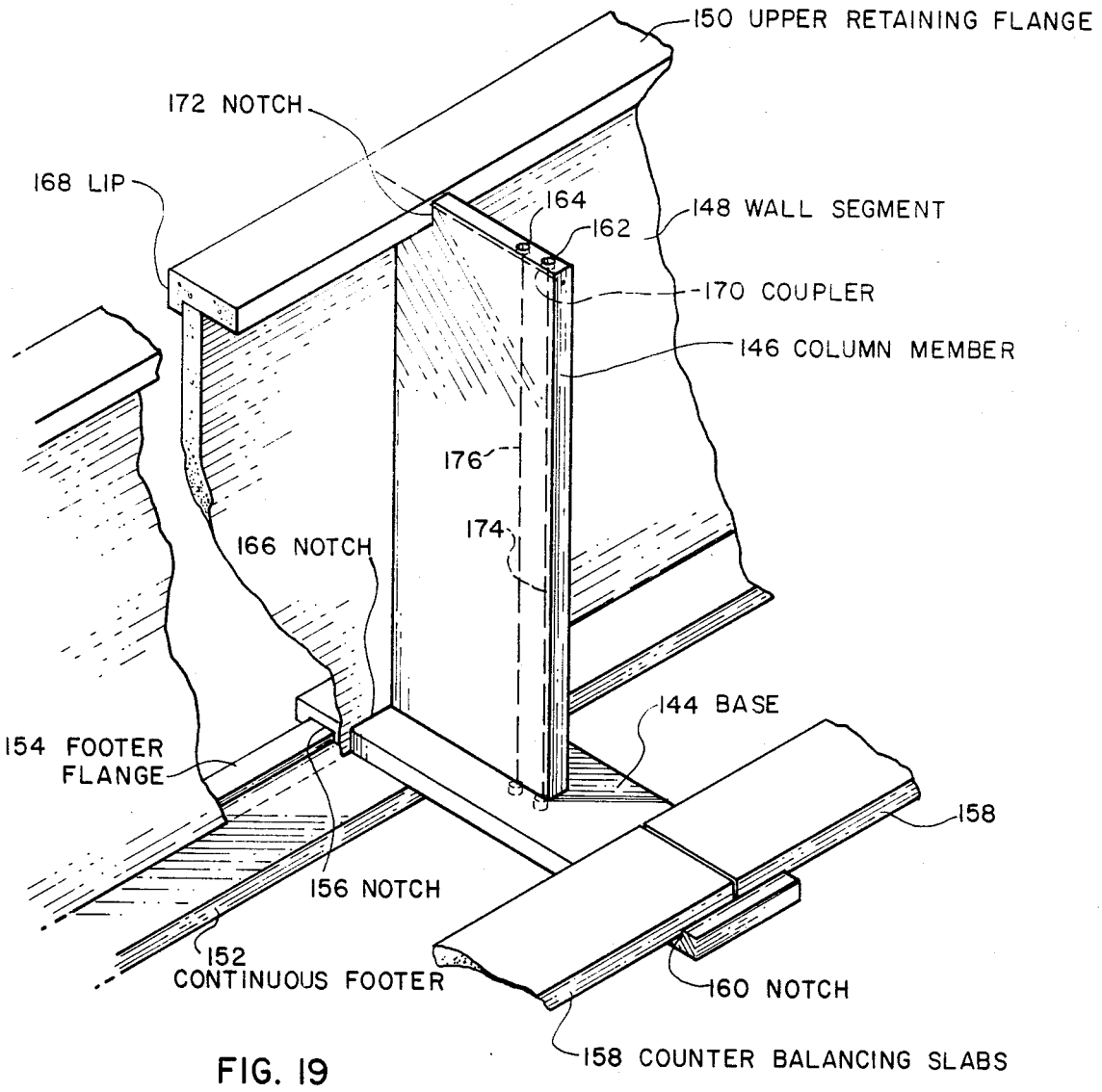
FIG. 19 is a schematic isometric view of an additional embodiment of the present invention.

FIG. 19 discloses an additional embodiment of the present invention which can be utilized to produce large, flush, vertical walls. As illustrated in FIG. 19, a base portion is disposed over a continuous footer 152 having a footer flange 154 which is keyed into base 144 at notch 156. Column member 146 is post-tensioned to base 144 by post-tensioning devices 174 and 176. Wall segments 148 are placed on the top of continuous footer 152 against footer flange 154 which provides resistance to movement in a horizontal direction. Wall segment 148 has a notched portion 166 which fits around base 144. Upper retaining flange 150 has a lip 168, which wall segment 148 abuts against. Upper retaining flange 150 fits in notch 172 in column member 146 and is connected to column member 146 by coupler 170 which is disposed horizontally through upper retaining flange 150 and through the upper portion of column member 146. Lip 168 provides resistance to horizontal movement produced by backfill against wall segment 148. Counterbalancing slabs 158 can also be used in conjunction with base 144 to provide counterbalancing forces to offset overturning moment forces. Counterbalancing slabs 158 are disposed in notch 160 of base 144 to prevent displacement of counterbalancing slabs 158 and to provide sliding resistance to horizontal forces from backfill.

Figure 20:
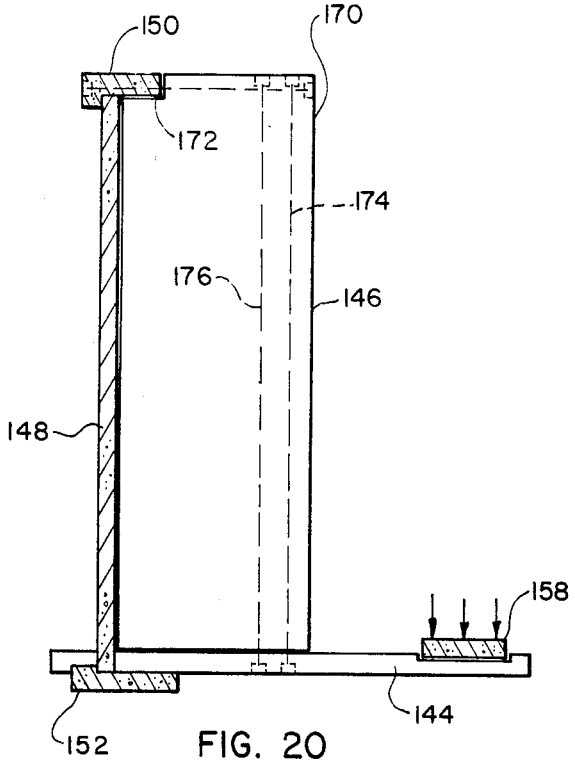
FIG. 20 is a schematic side elevation view of the device illustrated in FIG. 19.

FIG. 20 is a schematic side elevation of the diagram of the device illustrated in FIG. 19. As illustrated in FIG. 20, post-tensioning devices 174, 176 are disposed through column member 146. Although only two post-tensioning devices 174 and 176 are illustrated in FIG. 20, any number of post-tensioning devices can be utilized in accordance with the present invention for the purpose of joining base member 144 and column 146 and imparting added strength to column member 146.

Figure 21:
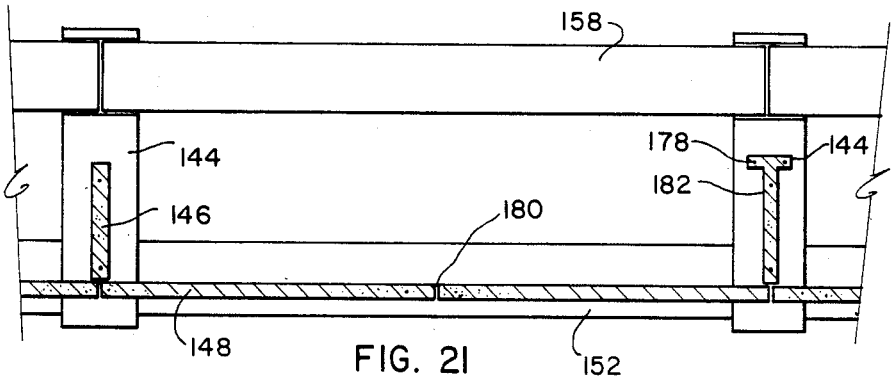
FIG. 21 is a schematic plan view of the embodiment of FIG. 19 illustrating various modifications.

FIG. 21 is a schematic plan view of the device illustrated in FIG. 19. As illustrated in FIG. 21, individual wall segments adjoin with one another at a point adjacent to column member 146 and/or at any point along the extent of the wall surface, such as illustrated by joint 180. Column member 182 can also be used as an alternative to column member 146. Column member 182 has a cross-sectional Tee configuration which provides additional stability to the coupling of the column member 182 to base member 144.

Figure 22:
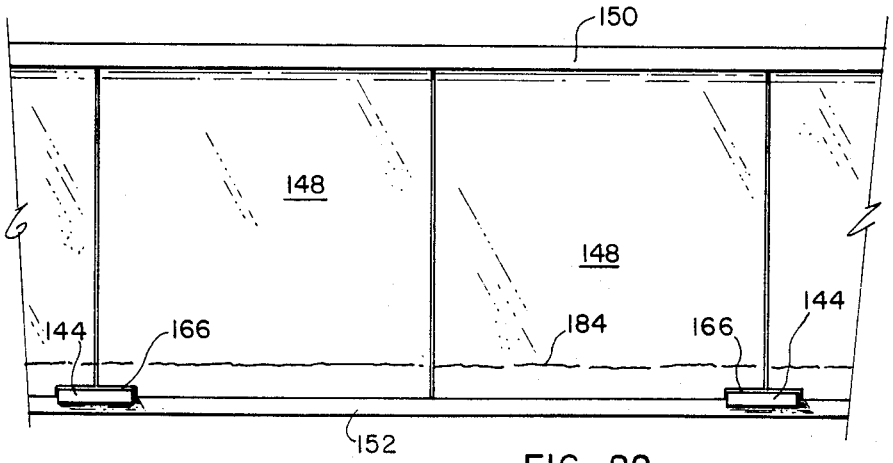
FIG. 22 is a schematic front elevation view of the device illustrated in FIGS. 19–21.

FIG. 22 is a schematic front elevation view of the embodiment illustrated in FIG. 19. As shown in FIG. 22, the ground or road level 184 is sufficiently high to cover base member 144 and continuous footer 152. Consequently, no structural members protrude from the vertical wall as illustrated in FIG. 22. The lack of structural protrusions from the surface of the wall not only adds to the aesthetic value of the wall, but also provides an important safety factor where the wall must be deployed near a roadway such that a vehicle could impinge upon a structural member. An additional advantage of the vertical wall illustrated in FIGS. 19–22 is its ability to provide a vertical retaining structure of substantial height, i.e., 30 feet or more, having substantial strength. Again, the vertical wall of FIGS. 19–22 utilizes locally available backfill to reduce cost. Wall segment panels 148 can be decoratively coated with a large number of decorative coating surfaces to further add to its aesthetic value.

Figure 23:
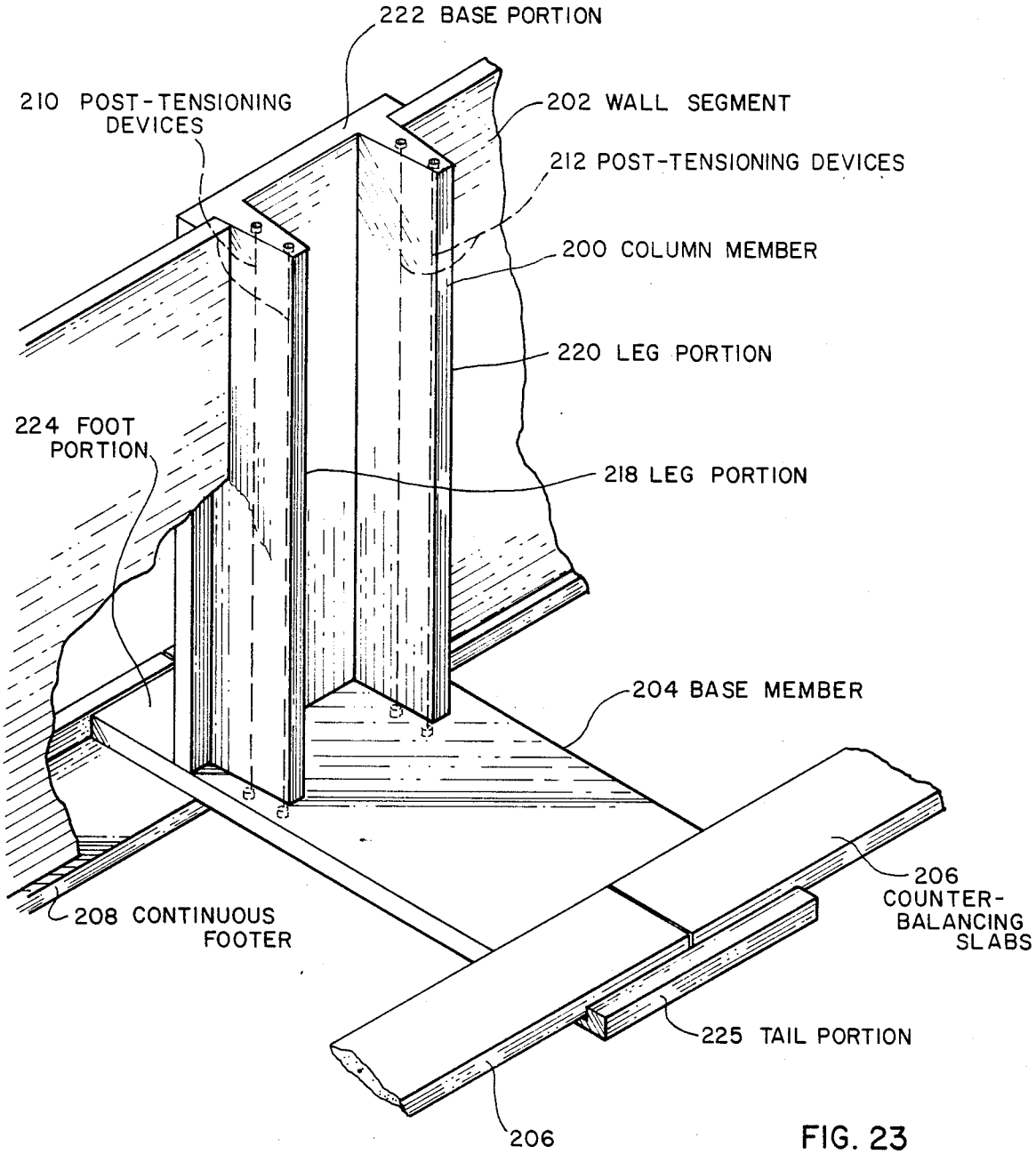
FIG. 23 discloses an additional embodiment of the invention.

FIG. 23 discloses an additional embodiment of the present invention utilizing a column member 200 having a double Tee configuration. Column member 200 is positioned on base member 204 and coupled to base member 204 utilizing post-tensioning devices 210, 212 which provide sufficient strength to withstand bending moment forces produced by backfill. Post-tensioning devices 210, 212 also impart added strength to leg portions 218, 220 of column member 200. Column member 200 is mounted on base member 204 such that the base member extends in a lengthwise direction beyond the column member 200 to form a foot portion 224 which increases the lever arm of the base member 204 by an amount sufficient to decrease bearing pressures on foundation soil below the foot portion resulting from overturning moment forces to meet design level pressures. Continuous footer 208 is disposed below foot portion 224 to further reduce pressure levels by spreading forces produced on foot portion 224 over a larger surface area, i.e., the surface area under continuous footer 208 between support structures. Continuous footer 208 can comprise a precast component which is mass produced at a precasting concrete plant or can be poured to grade on location. Wall segments 202 are disposed between adjacent support structures and abut against base portion 222 of column member 200. Backfill disposed behind wall segments 202 hold the wall segments 202 in position against column member 200. Counterbalancing slabs 206 are disposed on tail portion 225 of base member 204 and can be keyed in position as illustrated in FIG. 23. Counterbalancing slabs 206 increase the horizontal surface so as to increase the resistance force ($F_v$).

FIG. 24 is a plan view of the embodiment illustrated in FIG. 23. As illustrated in FIG. 24, wall segments 202 are disposed between adjacent column members 200 and abut against face portion 222 in a transverse direction and against leg portions 218, 220 in a lengthwise direction.

FIGS. 25 and 26 are cross-sectional views of FIG. 24 illustrating alternative modifications of base member 204 and continuous footer 208. As illustrated in FIG. 25, continuous footer 214 can be formed in an L configuration to abut against face portion 204. Rebar 215 provides support to the L portion of footer 214. As illustrated in FIG. 26, continuous footer 216 can have a flange 217 which is keyed into base member 204.

FIG. 27 shows an alternative manner of positioning post-tensioning device 226 in column member 200. Post-tensioning device 226 provides added strength to column member 200 at a lower portions where bending moment forces are the greatest.

An advantage of the embodiment illustrated in FIGS. 23–27 is that face portion 222 functions as a portion of the retaining wall and consequently decreases the total area of wall segments 202. Additionally, the double Tee configuration significantly increases the stability of the unitary support structure by providing two leg portions 218, 220 through which post-tensioning devices 210, 212 can be used to couple the column member 200 and base member 204.

Consequently, the various embodiments of the present invention provides a retaining wall system of superior strength and aesthetic value at a low cost which can be simply and easily installed. The components of the present invention can be mass produced at a concrete pre-casting plant and easily transported at low cost to location for assembly using post-tensioning devices which provide sufficient strength to form a unitary structure capable of withstanding bending moment forces and to impart added strength to individual components to reduce size and weight and consequently provide additional cost savings.

The foregoing description of the invention has been presented for the purposes of illustration and description. It is not intended to be exhaustive or to limit the invention to the precise form disclosed, and other modifications and variations may be possible in light of the above teachings. The embodiment was chosen and described in order to best explain the principles of the invention and its practical application to thereby enable others skilled in the art to best utilize the invention in various embodiments and various modifications as are suited to the particular use contemplated. For example, the retaining wall systems disclosed can be utilized as partially battered walls, i.e., walls that have an inclination toward the embankment, to reduce the amount of backfill which is retained, and consequently, reduce horizontal forces on the wall. This further decreases wall system specifications and adds further cost savings to the wall system. It is intended that the appended claims be construed to include other alternative embodiments of the invention except insofar as limited by the prior art.

What is claimed is:

1. A modular retaining wall system which can be transported in incremental pieces and assembled at an installation location comprising:

precast prestressed wall segment means having a load carrying capacity sufficient to withstand transverse forces from backfill retained by said prestressed wall segments;

separate precast column member means for supporting said prestressed wall segment means in response to said transverse forces from said backfill, said modular column member means formed from precast concrete Tee beam forms such that said column member means have base portions and leg portions adjoining said base portions at a substantially normal angle and substantially centered on said base portion;

separate precast base member means formed from precast concrete Tee beam forms such that said base member means have base portions and leg portions adjoining said base portions at a substantially normal angle and substantially centered on said base portions, said base portions extending beyond said leg portions in a lengthwise direction by a predetermined distance to form foot portions having surface areas sufficiently large to reduce bearing pressures on soil below said foot portions to meet design limits and extending in a transverse direction a predetermined distance to form flanges, said leg portions of said precast base member means and said flanges having a surface area which engages sufficient backfill to produce resisting forces which, in combination with the weight of said base members means, are sufficient to overcome overturning moment forces produced by said backfill;

first post-tensioning means for joining said separate precast base member means and said separate precast column member means at a substantially normal angle and imparting increased strength to said base member means, said first post-tensioning means disposed through said leg portions of said column member means and said foot portions of said base member means such that said column member means rests on said foot portions of said base member means;

second post-tensioning means disposed through said leg portions of said base member means and said leg portions and said base portions of said column member means for coupling said leg portions of said base member means and said column member means together to form web portions between said base member means and said column member means which provides sufficient stability to forces produced by said backfill on said base member means and said column member means to form a unitary structure having sufficient strength to withstand bending moment forces, and for imparting increased strength to said column member means;

whereby said increased strength of said base member means imparted by said first post-tensioning means and said increased strength of said column member means imparted by said increased strength of said second post-tensioning means and said wall segment means imparted by prestressing reduces the size and weight of said base member means, said column member means and said wall segment means for greater ease in handling and transporting.

2. The system of claim 1 wherein said predetermined distance said base portion is extended to form said foot portion increases the lever arm of said base member means sufficiently to decrease overturning moment forces at said foot portion such that total vertical forces at said foot portion produce pressures which are less than bearing pressures which induce soil failure.

3. The support structure of claim 2 further comprising:

counterbalancing slab means disposed on tail portions of said base member means which decreases the length of said base member means by increasing vertical forces on said tail portions of said base member means to offset overturning moment forces on said tail portions, said vertical forces on said foot portions resulting from the weight of said counterbalancing slab means disposed on said base member means and from resisting forces produced by backfill engaged by said counterbalancing slab means.

4. The system of claim 3 further comprising:

continuous footer means disposed under said foot portions between adjacent base member means for off-setting overturning moment forces of said backfill produced on said column means and reducing pressure levels resulting from said overturning moment forces.

5. The system of claim 4 wherein said support means comprises a concrete slab.

6. The system of claim 2 further comprising:

cross-tie means disposed between and coupled to opposing column member means to reduce bending moment forces;

sleeve means surrounding said cross-tie means to protect said cross-tie means from corrosion.

7. The system of claim 6 wherein said cross-tie means comprises:

a cable anchored to said opposing column member means.

8. The system of claim 6 wherein said cross-tie means comprises:

a bar anchored to said opposing column means.

9. The system of claim 3 further comprising:

anchor means coupled to said column member means to reduce bending moment forces;

sleeve means surrounding said cross-tie means to protect said cross-tie means from corrosion.

10. The system of claim 9 further comprising:

facia panel means for providing an external appearance of a continuous uniform slope along the top edge between a plurality of adjacent retaining wall units;

facia panel anchor means disposed in lateral portions of said base portions extending beyond said leg portions of said column member means;

retaining panel means coupled to said anchor means for securing said facia panel means to said column member means.

* * * * *